US007832023B2

(12) United States Patent
Crisco

(10) Patent No.: US 7,832,023 B2
(45) Date of Patent: Nov. 16, 2010

(54) PROTECTIVE HEADGEAR WITH IMPROVED SHELL CONSTRUCTION

(76) Inventor: Joseph J. Crisco, 97 Ferry La., Barrington, RI (US) 02806

( * ) Notice: Subject to any disclaimer, the term of this patent is extended or adjusted under 35 U.S.C. 154(b) by 407 days.

(21) Appl. No.: 11/292,542

(22) Filed: Dec. 2, 2005

(65) Prior Publication Data

US 2006/0137073 A1 Jun. 29, 2006

Related U.S. Application Data

(60) Provisional application No. 60/633,936, filed on Dec. 7, 2004.

(51) Int. Cl.
*A42B 3/00* (2006.01)

(52) U.S. Cl. ..... 2/414; 2/411; 2/410

(58) Field of Classification Search ..... 2/410–414
See application file for complete search history.

(56) References Cited

U.S. PATENT DOCUMENTS

| | | | | |
|---|---|---|---|---|
| 2,049,723 | A * | 8/1936 | Pomeranz | 607/110 |
| 3,026,525 | A * | 3/1962 | Gyorfy | 2/8.1 |
| 3,366,971 | A * | 2/1968 | Scherz | 2/412 |
| 4,290,149 | A * | 9/1981 | Aileo | 2/414 |
| 4,432,099 | A * | 2/1984 | Grick et al. | 2/412 |
| 4,564,959 | A * | 1/1986 | Zahn | 2/411 |
| 4,745,637 | A * | 5/1988 | Steele et al. | 2/411 |
| 4,766,614 | A * | 8/1988 | Cantwell et al. | 2/414 |
| 5,319,808 | A * | 6/1994 | Bishop et al. | 2/416 |
| RE35,193 | E * | 4/1996 | Shifrin | 2/410 |
| 5,724,681 | A | 3/1998 | Sykes | |
| 5,787,507 | A * | 8/1998 | Sullivan | 2/182.1 |
| 6,105,176 | A * | 8/2000 | Egger | 2/425 |
| 6,226,801 | B1 | 5/2001 | Alexander et al. | |
| 6,298,483 | B1 | 10/2001 | Schiebl et al. | |
| 6,314,586 | B1 * | 11/2001 | Duguid | 2/411 |
| 6,343,385 | B1 * | 2/2002 | Katz | 2/411 |
| 6,381,760 | B1 * | 5/2002 | Lampe et al. | 2/425 |
| 6,389,607 | B1 | 5/2002 | Wood | |
| 6,425,141 | B1 | 7/2002 | Ewing et al. | |

(Continued)

OTHER PUBLICATIONS

Spyrou, E. et al, "Effect of Local Shell Geometry and Material Properties on Impact Attenuation of Ice Hockey Helmets", Sports Engineering (2000) 3, pp 25-35, Blackwell Science Ltd.

*Primary Examiner*—Shaun R Hurley
*Assistant Examiner*—Andrew W Sutton
(74) *Attorney, Agent, or Firm*—Barlow, Josephs & Holmes, Ltd.

(57) ABSTRACT

The protective helmet includes a rigid outer shell where the shell includes an undulating cross-sectional profile. A layer of impact-energy-absorbing material is positioned adjacent to the shell. The undulating profile of the shell can be any type of load spreading undulating profile, such as that of a sinusoidal or triangular wave configuration. The undulating load-spreading profile can be on the inner surface of the shell, on the outer surface of the shell or the entire cross-section of the shell may be undulating. The unique undulating profile makes the shell more rigid and spreads the impact load across the surface of the shell to thereby spread the deformation of the padding layer to prevent the shell from bottoming out of the impact-energy-absorbing material during an impact. As a result, a safer and more effective protective helmet is provided.

4 Claims, 10 Drawing Sheets

U.S. PATENT DOCUMENTS 6,434,755 B1 8/2002 Halstead et al.
6,446,270 B1 9/2002 Durr
6,453,476 B1 * 9/2002 Moore, III ..... 2/412
D465,067 S 10/2002 Ide et al.
6,730,047 B2 5/2004 Socci et al.
6,751,808 B2 6/2004 Puchalski
6,764,524 B1 7/2004 Korte
6,883,183 B2 4/2005 Morrow et al.
6,934,971 B2 8/2005 Ide et al.
2005/0196592 A1 * 9/2005 Tao et al. ..... 428/180

* cited by examiner

PROTECTIVE HEADGEAR WITH IMPROVED SHELL CONSTRUCTION

CROSS REFERENCE TO RELATED APPLICATION

This application is related to and claims priority from earlier filed U.S. Provisional Pat. application Ser. No. 60/633,936, filed Dec. 7, 2004.

BACKGROUND OF THE INVENTION

The present invention generally relates to protective headgear. More specifically, the present invention relates to protective headgear that includes an improved shell construction.

In the prior art, there are many different types of helmets. Helmets used by football players, bicyclists and others engaged in sports typically have a hard outer shell that covers energy-absorbing material, also known as padding.

For example, bicycle helmets typically have a hard plastic outer shell that covers expanded polystyrene. Polystyrene absorbs energy by developing multiple micro-fractures throughout its structure. Once a polystyrene helmet develops micro-fractures it ceases to provide impact protection (i.e., such helmets are unusable after a single impact). Also, football helmets typically have a dense polyethylene outer shell that covers polypropylene pads capable of absorbing multiple impacts. The pads may also be air or liquid filled. Other helmets, such as those used by soldiers, typically have a metal or composite shell; that is able to protect a soldier's head from certain types of high-energy impacts.

Also, helmets typically have a retention system to secure the helmet in proper position on the user's head. The straps commonly used for bicycle helmets are difficult to adjust, resulting in many bicyclists wearing helmets improperly positioned and providing limited protection. Football, hockey and lacrosse helmets also typically further include protection for the face, such as wire cage or impact resistance plastic. This face protection is also attached directly to the helmet construction.

The helmet shape and the extent to which it covers the head are important design considerations. Helmets are shaped differently depending on the use to which the helmet is to be put and the energy level of the impacts the user might experience. For example, football helmets are typically designed to protect the top, sides and front of the user's head while the wire cage protect the wearer's face.

Performance standards have been developed for certain types of helmets. For bicycle helmets, for example, the Snell B-95 Bicycle Helmet Standard involves a series of performance tests. A helmet passes the impact portion of the Snell test if it prevents a head from decelerating at a rate in excess of 300 G's when subjected to a specific test impact. The Snell 300 G's standard does not assure that a rider wearing a helmet meeting that standard will not suffer serious head injury. Head and brain injuries occur at deceleration levels well below 300 G's; also, riders can experience impacts that result in head deceleration levels above 300 G's. Similar testing is conducted and standards are set in place for other sports, such as football and lacrosse.

The governing bodies of sports such as football and lacrosse in which helmets must be able to maintain their energy-absorbing performance after multiple impacts require that these sport helmets meet standards such as those developed by the National Operating Committee on Standards for Athletic Equipment (NOCSAE). In these standards performance test require that for the specified impact conditions the acceleration of the headform fitted with the given helmet not exceed a power-weighted integral of acceleration-time curve value of 1200 SI.

Headgear construction for high impact sports, such as football, is of particular concern to ensure that the head is adequately protected. The head can be thought of as having three components: the skull; the brain, which consists of compressible matter; and the fluid filling the skull and in which the brain floats. Neither the skull nor the fluid is compressible; the brain, however, is compressible and, when forced against the skull, does compress, bruising brain tissue and perhaps causing hemorrhaging. When the skull experiences an impact, the force is transmitted through the skull and fluid; the inertia of the fluid results in the brain moving in a direction opposite from that of the force applied to the skull. If that force is applied suddenly (i.e., there is an impact) and is substantial enough, the brain moves through the fluid and strikes the inside of the skull at a point roughly opposite to the area of the skull that sustains the impact.

When the brain strikes the skull with moderate force, the brain tissue in the area of the brain that hits the skull is compressed and bruised. That typically results in a temporary cessation of nervous function (i.e., a concussion).

When the skull is subjected to a more substantial impact, the brain typically hits the inside of the skull at a higher speed; a larger area of brain tissue is compressed and damaged and brain hemorrhaging is common (i.e., contusion results). If minimal hemorrhaging occurs, the individual may experience symptoms similar to those of a concussion. More substantial hemorrhaging may result in a loss of blood supply to the brain and even death.

When the energy level of the impact to the skull is substantial enough, the skull fractures. When it does, some of the impact energy is dissipated. A fracture may be either linear or localized. A linear fracture, the simpler of the two, is essentially a straight line crack. A localized fracture is one in which multiple fractures occur in a single area. In such a fracture, it is common for skull bone material to be displaced; the displacement can result in bone material penetrating brain tissue, causing hemorrhaging and swelling.

FIG. 1, a perspective view and FIG. 2, a cross-sectional view through the line 2-2 thereof, show a prior art headgear construction 10, which may be a football helmet. The helmet 10 is shown to include typical prior art headgear construction, which includes an outer shell 12 as well as padding 14 that resides between the shell 12 and the wearer's head 16. A wire cage 18 is provided on the front of the helmet 10 to protect the face of the wearer 16.

The profile of the shell 12 of prior art headgear 10 is generally flat. A cushioning material 14, such as foam and air bladders are typically placed between the outer shell 12 and the user's head 16 to serve as an inner liner. These additional layers help absorb impact to help prevent trauma to the head 16. Due to the configuration of a flat outer shell 12, however, the impact is distributed over a fairly small area resulting in less than desired impact absorption. The use of the cushioning liner materials 14 is critical in prior art helmets 10 to ensure effective impact absorption. Thus, the primary focus in prior art helmets 10 in the improvement of the cushioning material 14 and the configuration thereof for better impact absorption not the outer shell configuration 12 and materials.

Prior art headgear 10 must focus on the improvement of the padding layer 14 and its construction because the localized impact area of known shells 12 cause the impact load to be concentrated in a relatively small area. FIG. 3 illustrates such impact concentration. When this occurs, the padding 14*a* in the region of the localized impact at shell portion 12*a* takes on the burden of cushioning the load and deforms accordingly. If the impact is great enough, which occurs frequently in football, the padding 14 cannot sufficiently handle the impact and, as a result, the shell 12 bottoms out against the wearer's head in the region 12*a* due to full compaction of padding 14*a* therebetween thereby increasing the risk of head injury. Essentially, when the padding is fully compacted when at a distance of D at 14*a* and shell 12 bottoms out at 12*a*, it can no longer provide the required cushioning. As a result, it is critical that the padding 14 not bottom out when the shell 12 is impacted.

To illustrate this, FIG. 12, a graph of acceleration against compression, shows that as the linear compresses and begins to bottom out, the resulting headform acceleration increases rapidly. Thus there is a need to reduce compression of the linear by spreading the impact force over a greater area that results in lower head acceleration for a given impact.

Moreover, repeated localized impacts which are not spread out over the surface of the shell an absorbed across the pads, will cause deformation so significant that the pad fails in that area thereby degrading the overall integrity of the headgear and increasing risk of injury.

Thus, prior art helmets are extremely limited as to how much impact it can sustain due to the nature of the (locally flat—of course its generally spherical) flat profile of the outer shell and cushioning intermediate layer. The only profiling of the outer shell, in known helmets, are solely for aesthetic purposes, which include vents, grooves and other stylized elements. These elements are not used for functionally improving the impact absorption capability or rigidity of the helmet.

Therefore, there is a need for a helmet that can better prevent head injuries by improving the configuration and design of the outer shell of the helmet. There is a further need for a helmet that has a shell construction that can better spread the load of an impact across the surface of the shell and through to a wide pad area thereunder. There is a need for a headgear construction that eliminates the bottoming out of padding to improve performance, integrity and life of the headgear. There is also a need for a headgear construction that can stiffen the overall performance of the shell.

SUMMARY OF THE INVENTION

The present invention preserves the advantages of prior art protective headgear. In addition, it provides new advantages not found in currently headgear and overcomes many disadvantages of such currently available headgear.

The invention is generally directed to the novel and unique protective headgear construction. The protective helmet includes a rigid outer shell where the shell includes an undulating cross-sectional profile. A layer of impact-energy-absorbing material is positioned adjacent to the shell. The undulating profile of the shell can be any type of load spreading undulating profile, such as that of a sinusoidal or triangular wave configuration. The undulating load-spreading profile can be on the inner surface of the shell, on the outer surface of the shell or the entire cross-section of the shell may be undulating. The unique undulating profile makes the shell more rigid and spreads the impact load across the surface of the shell to thereby spread the deformation of the padding layer to prevent the shell from bottoming out during an impact. As a result, a safer and more effective protective helmet is provided.

It is therefore an object of the present invention to provide an improved headgear construction that is safer and more protective than prior art protective headgear constructions. It is an object of the present invention to provide a headgear construction that can better prevent head injuries by improving the configuration and design of the outer shell of the helmet. Another object of the invention is to provide a headgear construction that has a shell construction that can better spread the load of an impact across the surface of the shell and through to a wide pad area thereunder. Yet another object of the invention is to provide a headgear construction that eliminates the bottoming out of padding to improve performance, integrity and life of the headgear. Another object of the present invention is to provide a headgear construction that has a shell that is more stiff than prior art shell to improve the overall performance of the headgear construction.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 4:
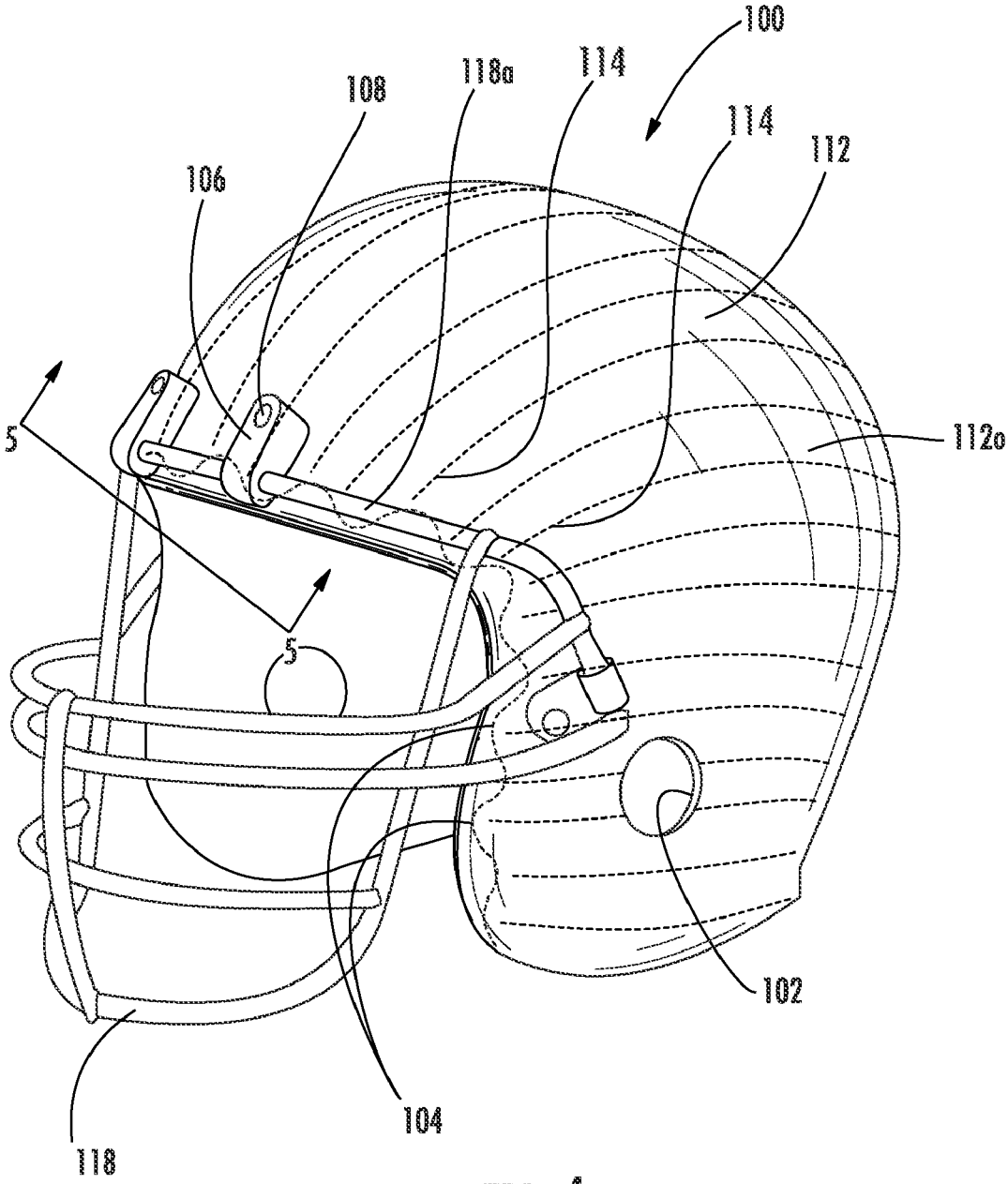
FIG. 4 is a perspective view of the preferred embodiment of the headgear construction of the present invention with a shell having an undulating inner surface.
Figure 5:
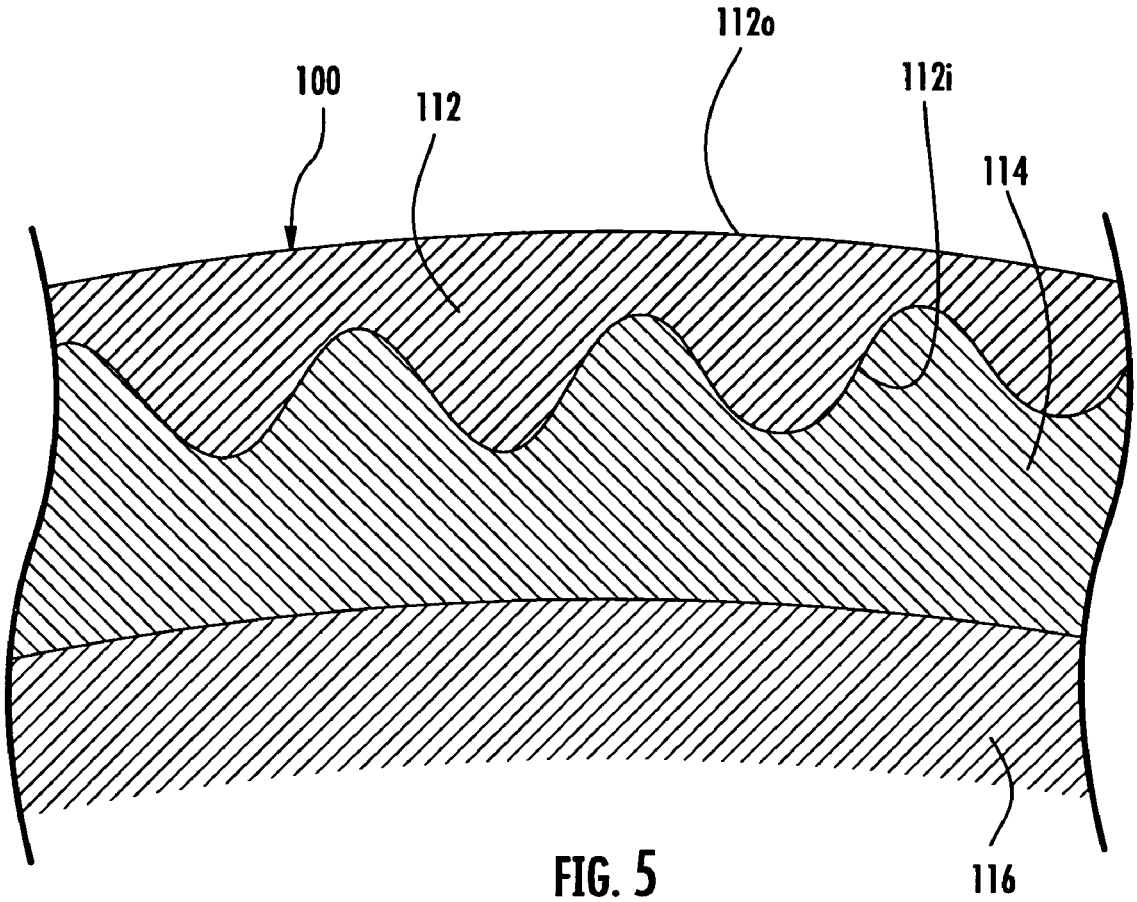
FIG. 5 is a cross-sectional view through the line 5-5 of FIG. 4.
Figure 6:
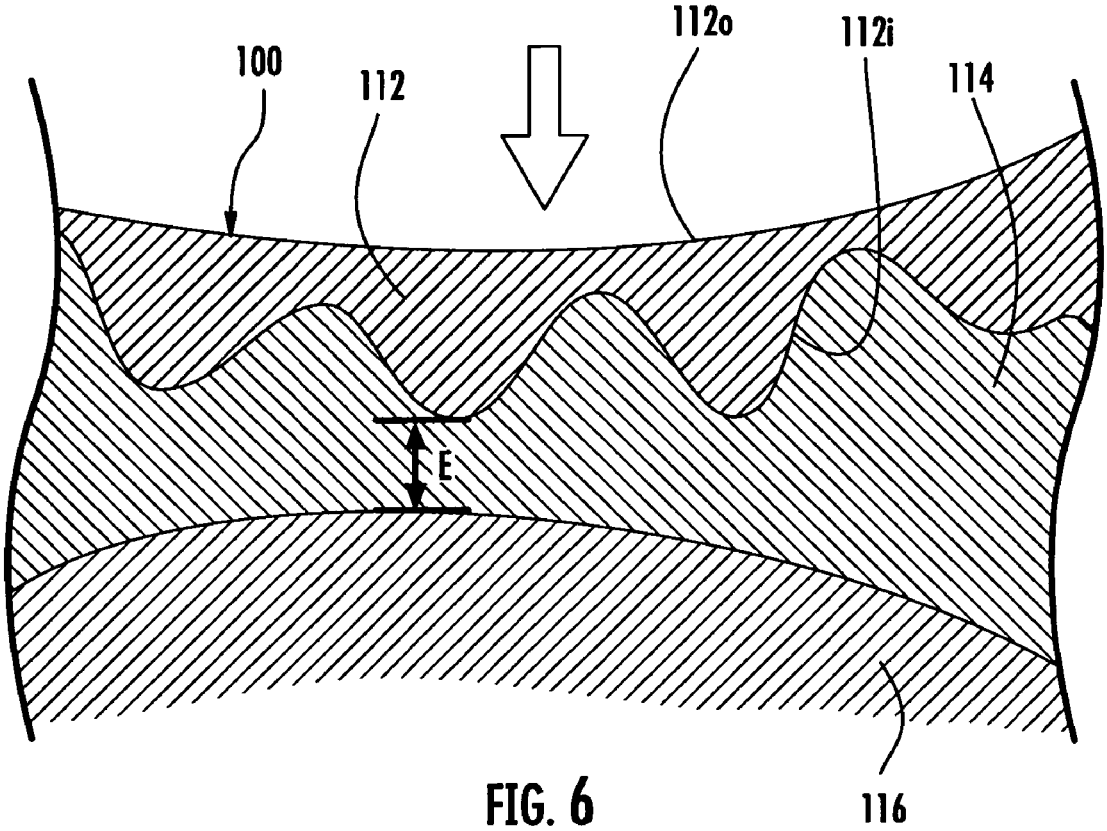
FIG. 6 is a cross-sectional view through the line 5-5 of FIG. 4 with an impact applied.

Turning first to FIGS. 4-6 a preferred embodiment of the headgear construction 100 of present invention is shown in detail. The headgear construction 100 of the present invention includes an outer rigid shell 112 with ear holes 102 and a front opening 104 to enable the wearer 116 to see in front of them. A cage 118 is affixed to the helmet 100 at the front opening 104 to protect the face of the wearer 116. The cage 118 can also be made of materials other than metal wire, such as plastic and polycarbonate.

Figure 1:
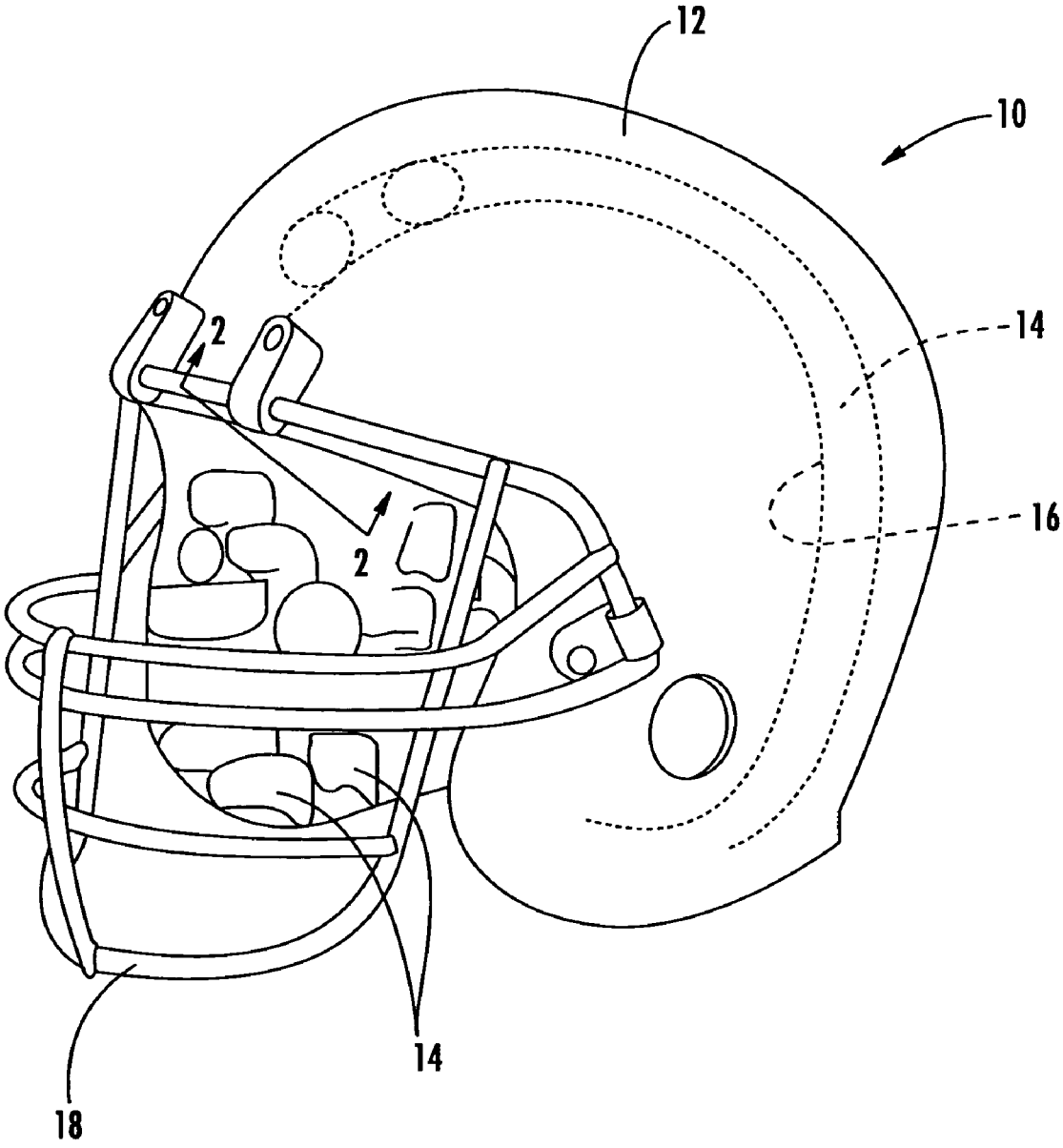
FIG. 1 (PRIOR ART)
FIG. 1 is a perspective view of a prior art headgear construction.
Figure 2:
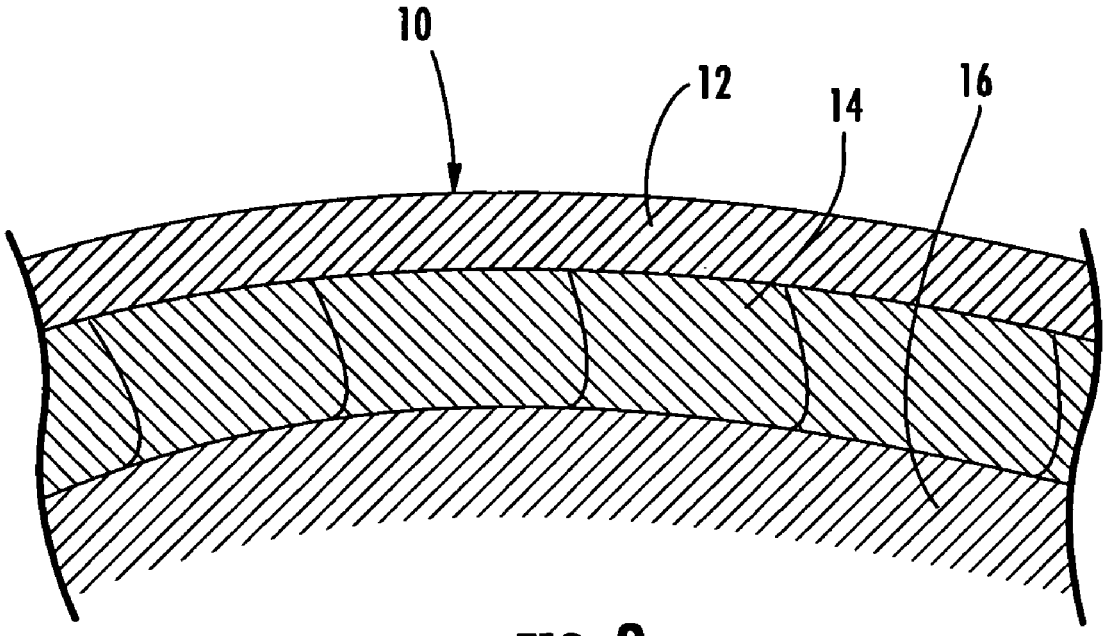
FIG. 2 (PRIOR ART)
FIG. 2 is a cross-sectional view through the line 2-2 of FIG. 2.
Figure 11:
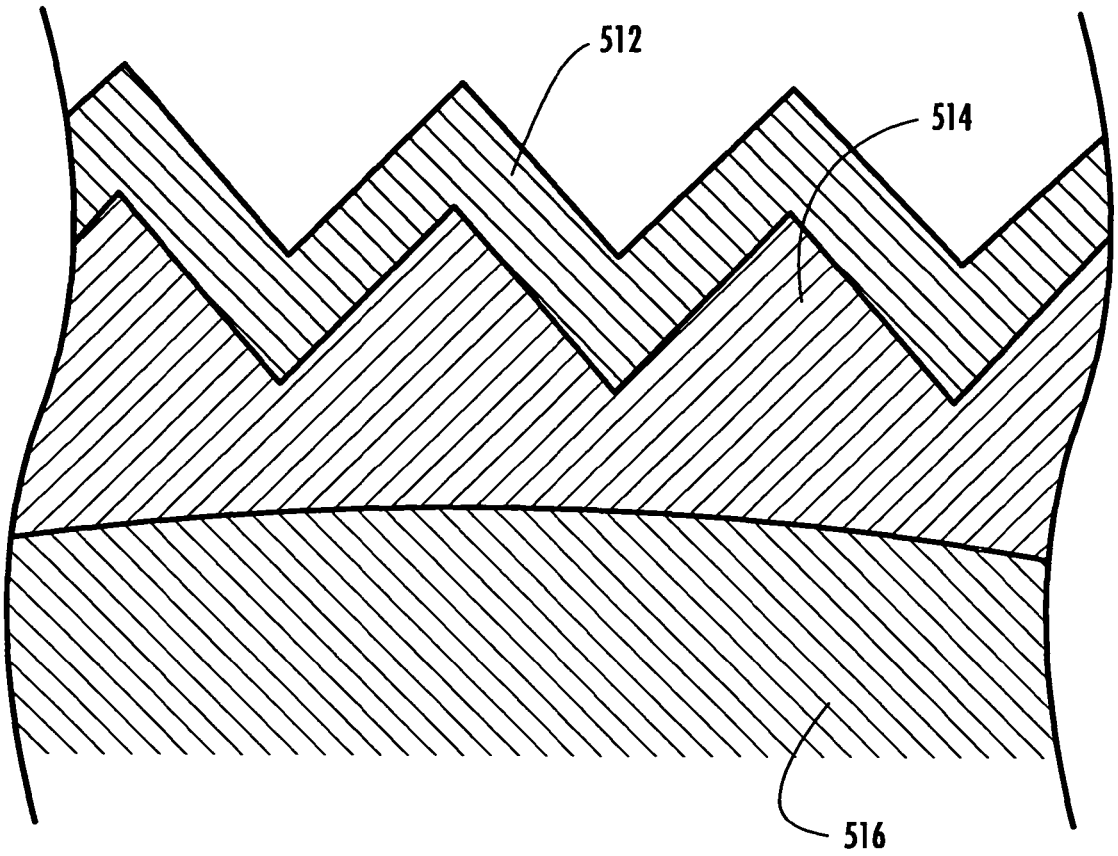
FIG. 11 is a cross-sectional view of another alternative embodiment of the shell of the present invention showing a triangular wave configuration.
Figure 12:
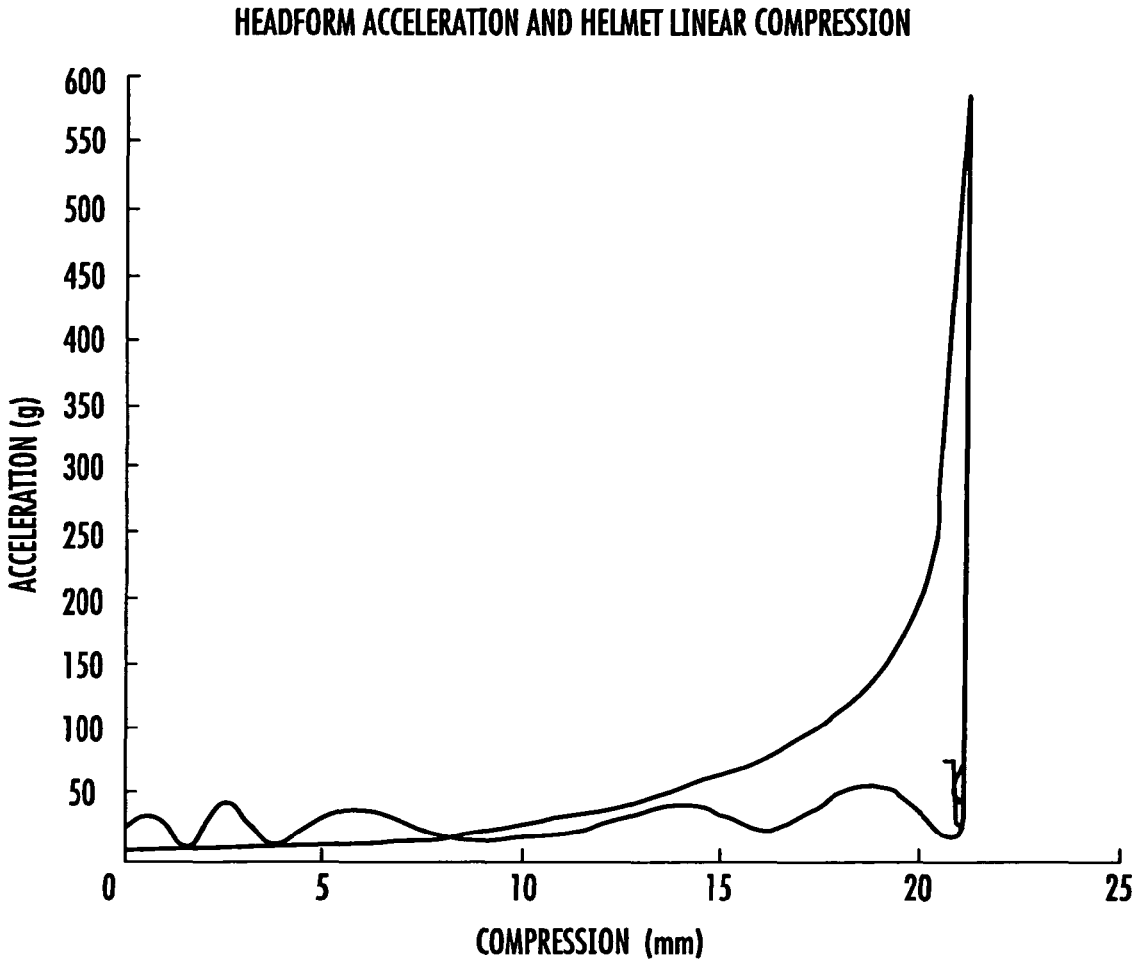
FIG. 12 is a graph showing headform acceleration and helmet linear compression.

The shell 112 of the present invention is unique in that it includes an undulating profile rather than the flat profile that is employed in prior art constructions, such as that illustrated in FIGS. 1 and 2. The undulating profile of the shell 112 can be any type of load spreading undulating profile, such as that of a sinusoidal or triangular wave configuration. A sinusoid profile is shown in FIGS. 4-6 while a shell 512 with triangular profile is shown in FIG. 11. In FIG. 11, padding 514 resides between the shell 512 and the wearer's head 516.

The undulating load-spreading profile can be on the inner surface 112*i* of the shell, on the outer surface 112*o* of the shell 112 or the entire cross-section of the shell 112 may be undulating. The unique undulating profile makes the shell 112 more rigid and spreads the impact load across the surface 112*i* of the shell 112 to thereby spread the deformation of the padding layer 114 to prevent the padding 114 from full compacting to cause the shell 112 to bottom out during an impact. As a result, a safer and more effective protective helmet 100 is provided.

The preferred sinusoidal wave profile can have any type of frequency and amplitude to suit the particular purpose and sport for which the helmet 100 is being used. For example, the undulations may have an amplitude of about 0.5 inches and a frequency of about 1 per inch and be about ⅛" inch thick. It is envisioned that any type of profile with any type of undulation is within the scope of the present invention.

Figure 3:
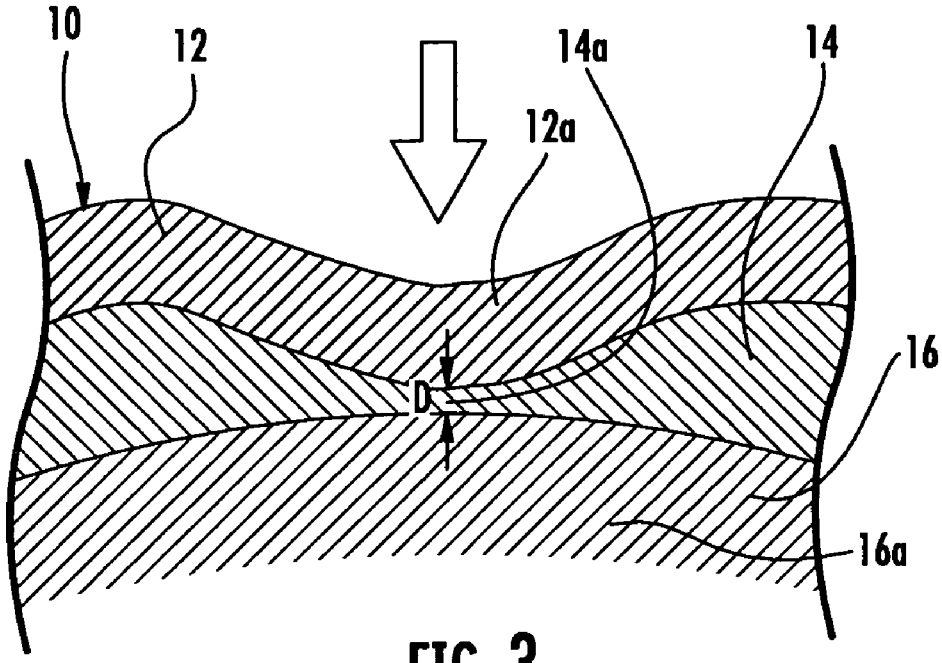
FIG. 3 (PRIOR ART)
FIG. 3 is a cross-sectional view through the line 2-2 of FIG. 2 with an impact applied.

FIG. 4 illustrates a preferred embodiment of the helmet 100 present invention where the rigid outer shell 112 has an outer surface 112*o* that is flat and an inner surface 112*i* that is undulating, namely, a sinusoidal wave configuration. In particular, FIG. 5 shows a cross-sectional view where the padding 114 is positioned between the rigid outer shell 112 with an sinusoidal inner surface 112*i* and the wearer's head 119. As stated above, the employment of an undulating surface of the shell 112 makes the shell more rigid thereby spreading the load of impact across the inner surface 112*i* of the shell thereby spreading the compressive force to the padding 114 making the padding much less likely to bottom out, namely, compressing the padding to a depth such that the padding is no longer effective in absorbing energy from an impact. Distance E is not enough downward distance to cause the padding 114 to be fully compacted. Thus, the distance E of compaction of padding 114 in FIG. 6 of the present invention is greater that the distance D of FIG. 3 which is the amount of compaction of the padding 14 in a prior art helmet configuration. With the same impact to the shell, the shell 112 is will not bottom as will the shell 12 in the prior art. As a result, a greater impact will be required to cause the shell 112 to bottom out than prior art shell 12.

As can be seen in FIG. 6, a focused impact in the middle of the shell, as represented by the arrow, causes the load to spread where none of the padding 114 across the width of the helmet 100 has bottomed thereby enabling the padding 114 to further provide a cushioning function to protect the head of the wearer 116. Thus, the shell 112 can be made more rigid than a shell that is made of the same material and thickness to better spread the load. As a result, with the same materials, a more rigid shell can be provided by the present invention.

Referring back to FIG. 4, the metal wire cage 118 or shield (not shown) is affixed to the shell 112 to protect the face of the wearer 116. The cage or shield 118 may be mounted to the shell 112 by any know method in the prior art. For example, a mounting bracket 106 can be secured to the shell, such as by a rivet 108, to receive the wire cage or shield 118. Also, the wire cage 118 or portion of the protective shield may be captured by the undulations of the shell 112. For example, as seen in FIG. 4, an upper wire 118 may be routed through apertures 112*b* and captured by the undulations in the shell construction 112. As a result of this unique cage mounting construction, mounting brackets 106 may be eliminated entirely or the number of mounting brackets 106 can be reduced in number to simplify the helmet construction 100. Use of less brackets 106 that may fail over time reduces the maintenance and improves the overall safety of the construction of the helmet 100 of the present invention.

The shell 112 of the present invention can be made of any type of material that is suitable for headgear constructions, such as plastic, polystyrene, polyethylene, carbon fiber, KEVLAR, epoxy fiber materials and any type of metal. Most preferably, polycarbonate plastic is employed for the shell 112 which is the most common material for shells 112 in protective headgear 100, including football and lacrosse helmets.

The shell 112 of the present invention, with its unique undulating surface profiling can be formed using any type of material formation methods know in the prior art, such as injection molding, thermo-forming and casting. For example, the shell 112 of the present invention is preferably injection molded, which is the typical method of forming football and lacrosse helmets in the prior art. The appropriate tooling (not shown) is provided to enable the desired undulations to be formed.

Figure 7:
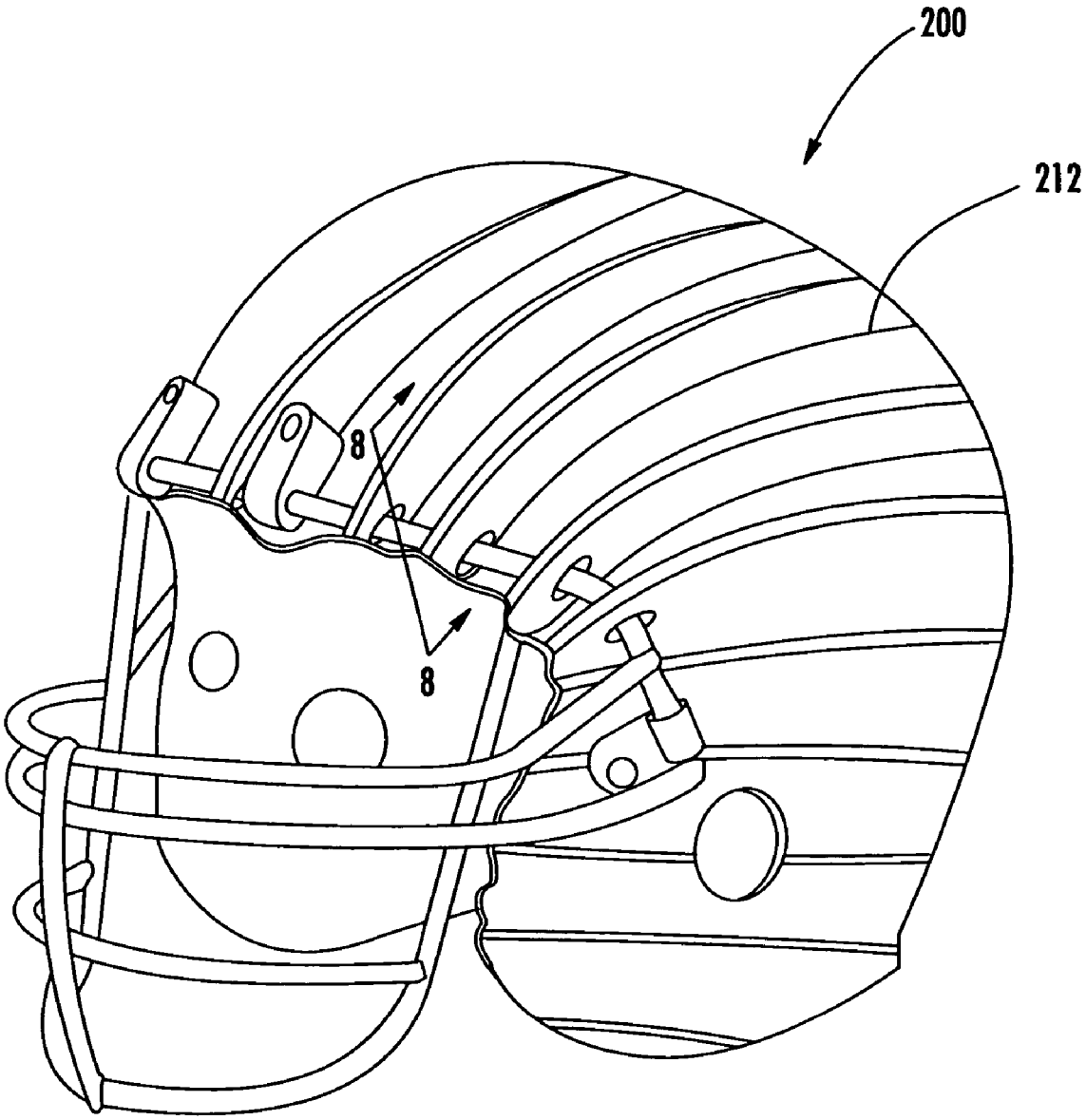
FIG. 7 is a perspective view of the preferred embodiment of the headgear construction of the present invention with a shell having an undulating inner surface and outer surface.
Figure 8:
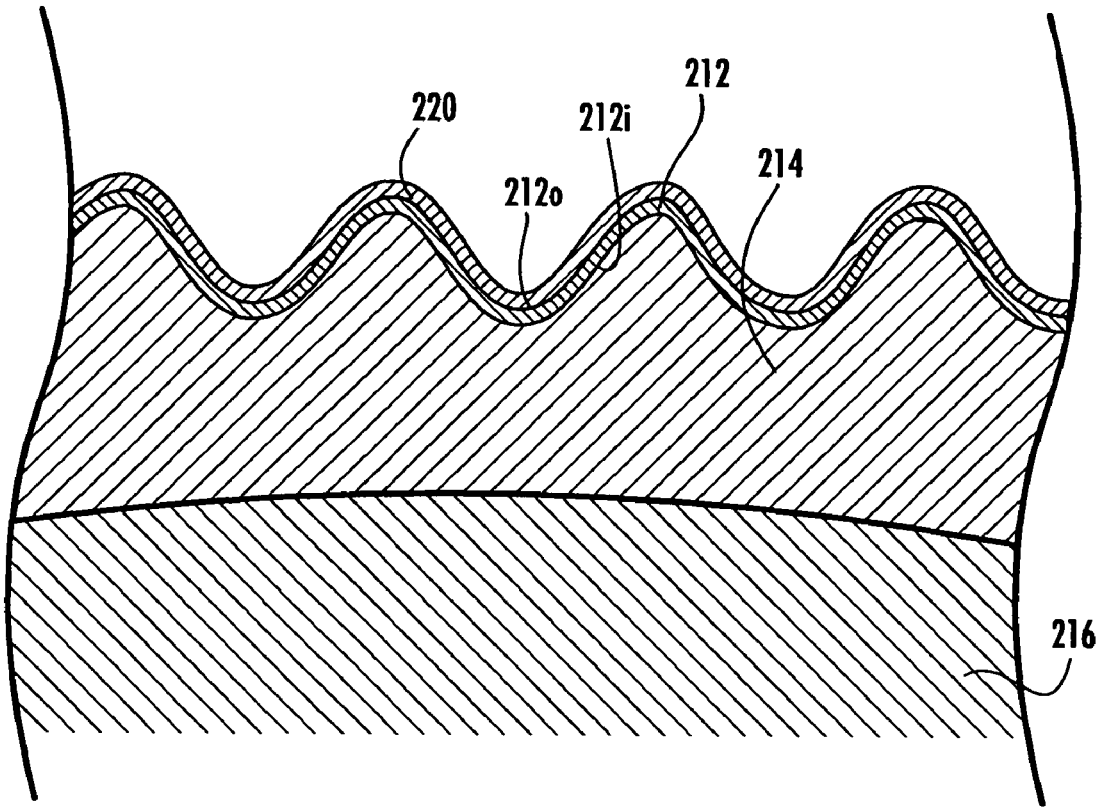
FIG. 8 is a cross-sectional view through the line 8-8 of FIG. 7.

Referring now to FIGS. 7 and 8, an alternative embodiment 200 of the headgear construction of the present invention is shown. FIG. 7 shows a perspective view of a helmet 200 that includes a shell 212 that has both an undulating inner surface 212*i* and an undulating outer surface 212*o*. FIGS. 7 and 8 show the undulating surfaces 212*i* and 212*o* to be both sinusoidal in profile. Thus, the outer surface 212*o* of the shell 212 will also have an undulating profile. Such a dual-sided undulating profiled shell 212 may be more desirable in certain applications and sports. Also, optionally, a further cushioning layer 220 may be adhered to the outer surface 212*o* of the undulating shell layer 212. A padding layer 214 is positioned between the shell 212 and the wearer 216.

Figure 9:
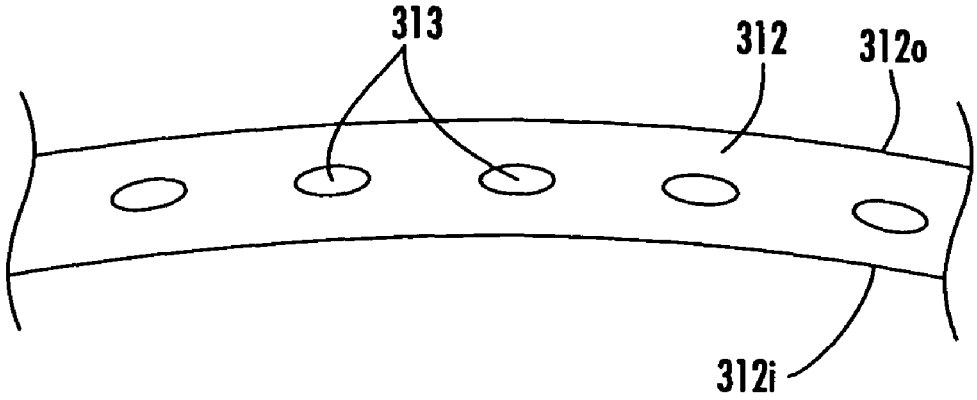
FIG. 9 is a cross-sectional view of a further alternative embodiment of the shell of the present invention.

Turning now to FIGS. 8 and 9, further alternative shell constructions 312 and 412 are illustrated. These shell profiles 312, 412 are more rigid than prior art flat shell profiles. FIG. 8 shows a shell construction 312 with a flat outer surface 312*o* and flat inner surface 312*i*. However, interior chambers 313 are provided to assist in spreading the load of an impact to the shell 312. Alternate shell construction 312 is incorporated into a helmet construction using padding and cage, as described above.

Figure 10:
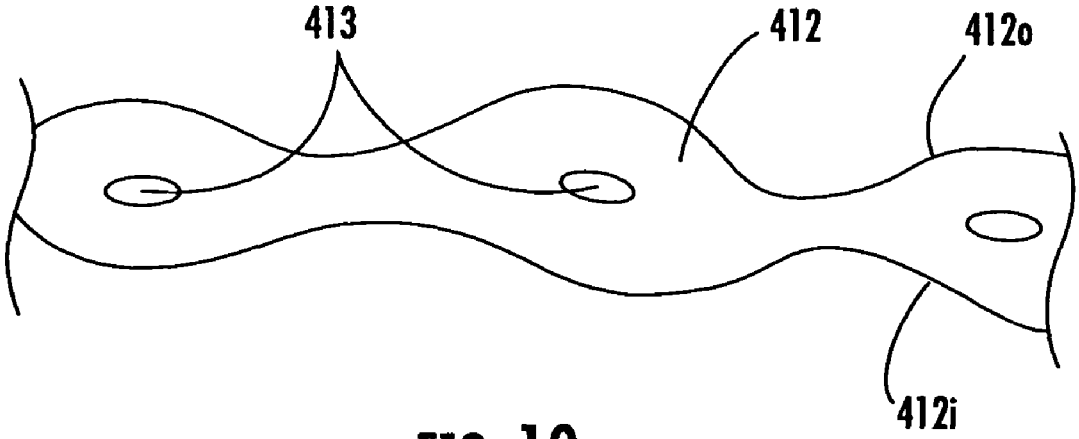
FIG. 10 is cross-sectional view of yet a further alternative embodiment of the shell of the present invention.

Similarly, FIG. 10 illustrates another alternative embodiment where interior chambers 413 are provided and the inner surface 412*i* and the outer surface 412*o* are profiled, such as with a sinusoidal configuration, to further assist in spreading the load of an impact to the shell 412. Alternate shell construction 412 is incorporated into a helmet construction using padding and cage, as described above.

Many different types of shell configurations are envisioned in accordance with the present invention to increase the rigidity of the shells 112, 212, 312, 412 and 512 to improve load spreading of an impact to the shells 112, 212, 312, 412 and 512 to prevent it from bottoming out against the padding. All of these variations that employ undulations to the inner surface and/or the outer surface of the shell 112, 212, 312, 412 and 512 are deemed to be within the scope of the present invention. For example, the undulations may have different frequencies, different amplitudes, different wave profiles and run in any direction relative to the head of the wearer and still be within the scope of the present invention.

In view of the foregoing, a new and improved headgear 100 construction with a new outer shell 112, 212, 312, 412 and 512 is provided that more efficiently distributes an impact load to a cushioning padding layer 114, 214. As a result, head and brain injuries can be more effectively be prevented.

It would be appreciated by those skilled in the art that various changes and modifications can be made to the illustrated embodiments without departing from the spirit of the present invention. All such modifications and changes are intended to be covered by the appended claims.

What is claimed is:

1. A protective helmet, comprising:

a rigid outer shell having an inner surface and an outer surface; the inner surface of the shell having portions with an undulating surface profile and the outer surface being non-undulating in configuration at those portions; the undulating surface profile being configured to increase the rigidity of the shell to provide improved distribution of impact energy imparted to the outer surface thereof; and a layer of impact-energy-absorbing material in communication with the inner surface of the shell and having an undulating surface profile substantially complementary to the undulating surface profile of the inner surface of the rigid shell.

2. The protective helmet of claim 1, wherein the undulating surface profile of the inner surface of the rigid outer shell and the undulating surface profile of the layer of impact-energy-absorbing material have a sinusoidal wave configuration.

3. The protective helmet of claim 1, wherein the undulating surface profile of the inner surface of the rigid outer shell and the undulating surface profile of the layer of energy-absorbing material have a triangular wave configuration.

4. The protective helmet of claim 1, wherein the rigid outer shell is made of a material selected from the group consisting of plastic, polystyrene, polyethylene, carbon fiber and metal.

* * * * *